United States Patent [19]

Merle et al.

[11] Patent Number: 4,946,171

[45] Date of Patent: Aug. 7, 1990

[54] LIVE FIRE TARGET MODULAR SUPPORT STRUCTURE

[75] Inventors: Thomas C. Merle, Rochester; William M. Dickman, Lyons, both of N.Y.

[73] Assignee: Eastman Kodak Company, Rochester, N.Y.

[21] Appl. No.: 293,781

[22] Filed: Jan. 3, 1989

[51] Int. Cl.[5] ..... F41J 1/08; F41J 9/13

[52] U.S. Cl. ..... 273/348.1; 273/407; 273/348; 273/371; 434/16

[58] Field of Search ..... 273/348, 348.1, 371, 273/372, 373, 407; 434/16

[56] References Cited

U.S. PATENT DOCUMENTS

| | | | |
|---|---|---|---|
| 3,737,166 | 6/1973 | Knight | 273/372 |
| 3,819,962 | 6/1974 | Ivey et al. | 273/372 |
| 4,253,670 | 3/1981 | Moulton et al. | 273/348.1 |
| 4,260,160 | 4/1981 | Ejnell et al. | 273/348.1 |
| 4,349,728 | 9/1982 | Phillips et al. | 273/372 |
| 4,422,646 | 12/1983 | Rosa | 273/348.1 |
| 4,546,983 | 10/1985 | Rosa | 273/348.1 |
| 4,659,089 | 4/1987 | Rosa | 273/348.1 |
| 4,706,963 | 11/1987 | Geuss | 273/348.1 |
| 4,799,688 | 1/1989 | Kellman et al. | 273/348.1 |

FOREIGN PATENT DOCUMENTS

| | | | |
|---|---|---|---|
| 0185877 | 7/1986 | European Pat. Off. | 273/348.1 |
| 3439689 | 5/1986 | Fed. Rep. of Germany | 273/348.1 |

*Primary Examiner*—William H. Grieb
*Assistant Examiner*—Jessica J. Harrison
*Attorney, Agent, or Firm*—Stephen C. Kaufman

[57] ABSTRACT

A modular target system support structure for use with modular target systems simultaneously provides support and electrical contact to a plurality of target modules upon mounting and securing of the same in place on the support structure. In one embodiment, the modular target system support structure includes mechanical clamps for securing the plurality of target modules in place and electrical contacts, positioned on the mechanical clamps, for making electrical contact with the target modules automatically upon mounting and securing of the same in place. Furthermore, the modular target system support structure requires no tools for mounting or replacing target modules on or off the target field.

24 Claims, 5 Drawing Sheets

FIG. 5
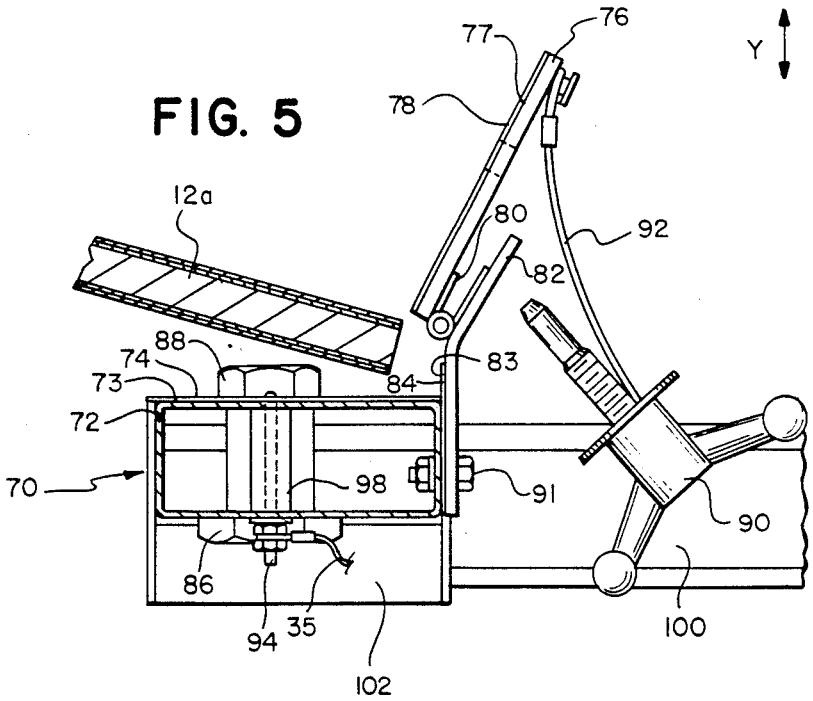
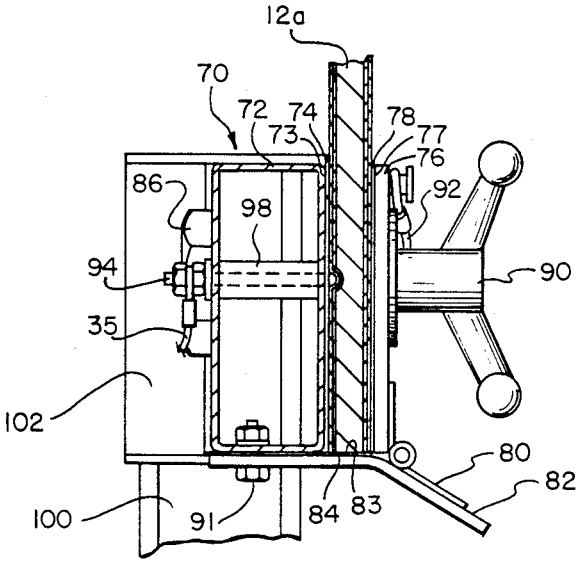
FIG. 6

LIVE FIRE TARGET MODULAR SUPPORT STRUCTURE

CROSS-REFERENCE TO COPENDING APPLICATION

This patent application contains subject matter related to subject matter disclosed in U.S. patent application Ser. No. 007,211, filed Jan. 27, 1987 by Kellman et al. (now U.S. Pat. No. 4,799,688, issued Jan. 24, 1989) and entitled "Live Fire Target System" and commonly assigned to the assignee of the present application.

BACKGROUND OF THE INVENTION

Technical Field

The present invention relates generally to target systems and more specifically to an electronic target system modular support structure which supports at least one target module and, upon mounting and securing said target module in place, automatically makes electrical contact with said target module.

Introduction to the Invention

In live fire training environments, target systems preferably provide both visual and thermal target silhouettes for firing upon. In addition, target systems also provide information regarding the size and location of any projectile hits through the target. These targets are spaced a substantial distance from a user, and, while having indoor applications, are often used for extended periods of time on outdoor ranges. Targets are, by their nature, shot upon and destroyed, and thus require frequent replacement.

It is known in the art to provide a target which presents a visual and thermal silhouette to users. U.S. Pat. No. 4,422,646 to Rosa shows a target comprising a multiplicity of modules, each module having sets of external wires, each set provided with an electrical connector for connecting to a power source. When energized, the target provides a thermal silhouette. This system suffers from the disadvantage that the electrical connections to the power source are sets of external wires and corresponding connectors. These external wires and connectors are succeptable to damage and, if damaged, render a target module inefficient or useless for its intended purpose. In addition, the modules are mounted by stapling onto a rigid surface such as a plywood sheet. This is a further disadvantage in that replacing destroyed modules is difficult, time consuming, and requires special tools on the outdoor range.

It is also known in the art to provide a support structure for a thermal target system. U.S. Pat. No. 4,260,160 to Ejnell et al. shows a thermal target system having a heat-absorbing sheet supported on a rigid frame. This system suffers from the disadvantage that when fired upon and destroyed, the system requires replacement of both the heat-absorbing sheet and the support structure. Such replacement is time consuming and requires special tools on the outdoor target field.

It would thus be desirable to provide a target system support structure which overcomes the disadvantages of the above-cited patents. Such a target system support structure should provide support and electrical connections simultaneously to target modules. Furthermore, such a support structure should require no special tools for target module mounting or replacement. Such a target system support structure should accommodate targets which are inexpensive to manufacture, are easily changed, and which are capable of surviving for required periods of time in an outdoor range environment.

SUMMARY OF THE INVENTION

A new and improved target system modular support structure is provided wherein at least one target module is supported and electrical contact is automatically made upon mounting and securing of the target module in place on said support structure. The target system support structure is for use with modular electronic target systems. The target system modular support structure provides for fast, easy replacement of destroyed target modules and furthermore requires no tools on the outdoor target field.

The invention has particular utility and is disclosed in conjunction with the target system described in U.S. patent application Ser. No. 007,211, filed Jan. 27, 1987 by Kellman et al. and entitled "Live Fire Target System" (now U.S. Pat. No. 4,799,688, issued Jan. 24, 1989) which provides information, in real time and to a remote user, regarding both the location and size of any projectile hits.

A target system modular support structure constructed in accordance with the present invention includes a means for simultaneously supporting and making electrical contact with at least one target module. The support structure simultaneously provides support and electrical contact to a target module, making electrical contact as the target module is secured in place on said support structure, thus facilitating fast, easy replacement of a target module.

In one embodiment of the present invention, the target system modular support structure comprises a mechanical clamp and a plurality of electrical conductors. The mechanical clamp serves to secure a target module in place. While the target module is being secured in place by the mechanical clamp, the plurality of electrical conductors automatically make electrical contact with the target module. The mechanical clamp is further provided with flexibly attached winged clamping bolts. The target module is positioned between two clamping surfaces of the mechanical clamp whereby the winged clamping bolts, fitting through holes in the clamp surfaces and the target module, rotatably tighten to secure the target module in place. As a result, no tools are required in the mounting or replacement of the target module.

BRIEF DESCRIPTION OF DRAWINGS

The subject matter which is regarded as the invention is particularly pointed out and distinctly claimed in the concluding portion of the specification. The invention itself, however, both as to its organization and its method of practice, together with further objects and advantages thereof, may best be understood by reference to the following description taken in conjunction with the accompanying drawing in which:

FIG. 5 shows a side view of a modular target system support structure constructed in accordance with the present invention in a substantially horizontal position; and FIG. 6 is a sectional view taken along line 6—6 of FIG. 3.

DETAILED DESCRIPTION OF THE INVENTION

Figure 1:
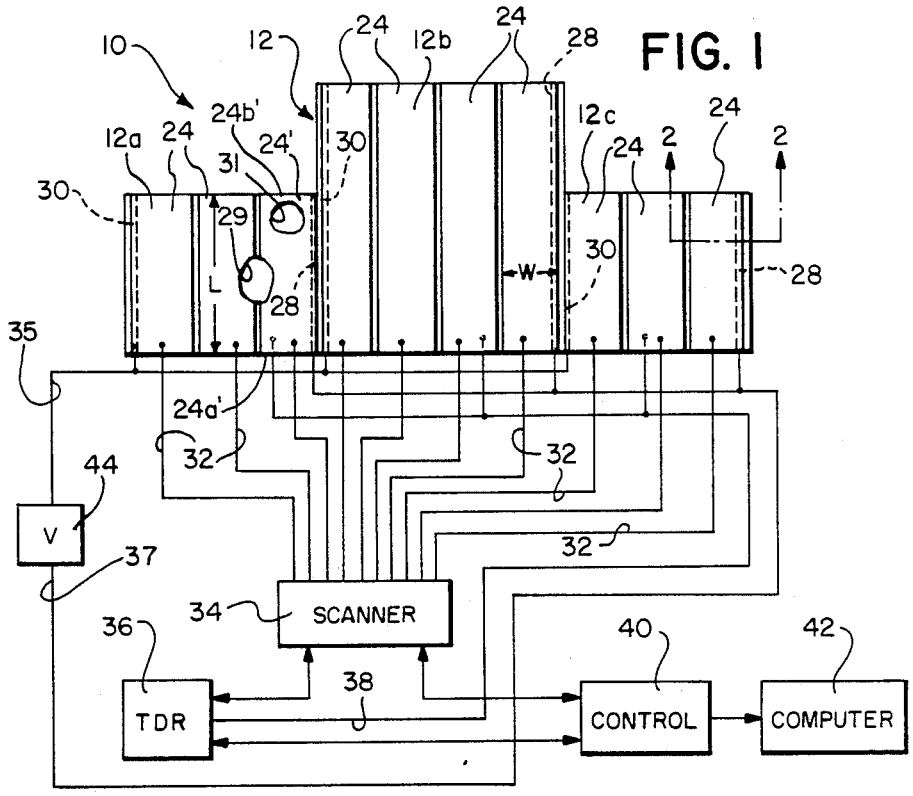
FIG. 1 is a plan view, partially in schematic form, of a target system used in conjunction with the present invention.
Figure 2:
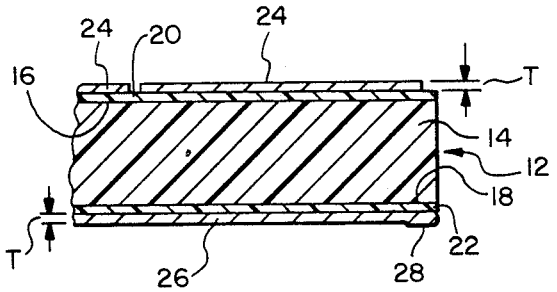
FIG. 2 is a sectional view taken along line 2—2 of FIG. 1.

Referring now to FIGS. 1 and 2, an electronic target system 10 comprises a target 12 including three modules 12*a*, 12*b*, and 12*c* arranged to present a silhouette selected to mimic that of a real life combat target, such as a tank. Excepting for size and shape, modules 12*a*, 12*b*, and 12*c* are constructed identically.

For purposes of explanation, the structure of these modules and hence target 12 will be described with respect to module 12*c*, a sectional view of which is shown in FIG. 2. Target 12 includes a dielectric support 14 defining mutually parallel target and back surfaces 16 and 18, respectively. A thin, flexible, dielectric base 20 overlies target surface 16 of support 14 and is mounted thereon, for example, by a suitable adhesive. Similarly, a thin, flexible, dielectric base 22 is likewise mounted on back surface 18. Disposed on base 20, and hence overlying target surface 16, are a plurality of generally rectangular, spaced, and parallel electrically conductive strips 24. Disposed on base 22, and hence overlying back surface 18 of target 14, is an electrically conductive backplane 26. Proximate opposing lateral edges (as viewed in FIG. 1) of each module 12*a*, 12*b*, and 12*c*, regions of backplane 26 are thickened to form a pair of electrical bus-bars 28, 30 for conducting an electrical current through the backplane. Holes 29 and 31 in module 12*a* indicate "hits", or areas where projectiles have passed through target 12.

• Support 14 comprises a stiff, homogeneous, water-resistant, thermal and electrical dielectric material such as a resin-impregnated paper or a plastic. Support 14 is selected to be thick enough to support the weight of target 12, but preferably doesn't exceed about 1.00 inch in thickness. Bases 20, 22 each comprise a thin layer, preferably 4—7 mils thick, of a flexible dielectric material such as Estar polyethylene terephthalate plastic (Estar is a registered trademark of Eastman Kodak, Company), a polyimide, or a resin-impregnated paper. Strips 24 and backplane 26 comprise thin layers of conductive material such as carbon or a metal. Suitable, exemplary metals include copper, nickel, or stainless steel. These metals are preferably coated on bases 20, 22 by a fast, economical process of vapor deposition. The thicknesses T of strips 24 and backplane 26 are dependant on the resistivity of the metals chosen, but are generally in the range of from 1,000–2,000 angstroms, with the thicknesses of bus-bar regions 28, 30 increasing to about 5,000–7,000 angstroms. The width W of conductive strips 24 is selected to be greater than the largest diameter of the projectiles to be fired at target 12. For example, and without limitation, when 10 inch projectiles are to be fired at target 12, strips 24 are preferably chosen to have a width W of 12 inches, and to be spaced about ¼–½ inches apart.

Connected proximate a first, lower (as viewed in FIG. 1) end of each strip 24 via separate conductors 32 is a scanner 34. Scanner 34 comprises, for example, a commercially available, high-frequency multiplexer, or an R.F. switch. Connected at a port of scanner 34, so as to be separately connectable to any selected one of strips 24 through the scanner, is a Time Domain Reflectometry (TDR) pulse generator 36. TDR pulse generator 36 is further connected to backplane 26 of each module 12*a*, 12*b*, and 12*c* via a conductor 38. In this manner, each strip 24, being spaced from backplane 26 as described above, appears as a micro-strip transmission line to TDR pulse generator 26. TDR pulse generator 36 comprises, for example, a Model 1502 or 1503 Cable Tester commercially available from Tektronix, Inc.

A computer controller 40, comprising, for example, a commercially available, digital, mini-computer, is connected to both scanner 34 and TDR pulse generator 36. Controller 40 is in turn connected to a reporting computer 42 which similarly comprises a mini-computer. A voltage source 44 is connected between bus-bars 28, 30 on backplane 26 of each module 12*a*, 12*b*, and 12*c*. It will be understood that, though not shown, some standard means of electrical isolation is preferably provided between voltage source 44 and the remaining electronic components in target system 10. An isolation transformer, for example, would suffice.

Figure 3:
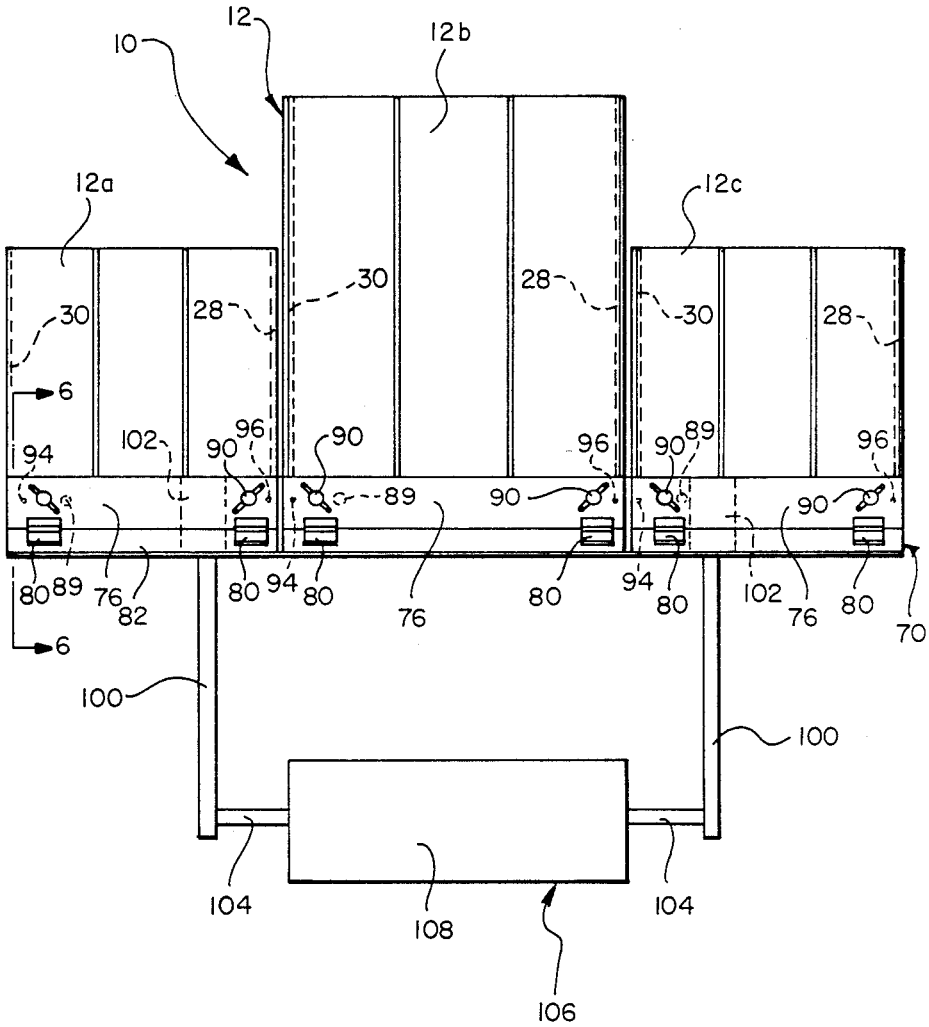
FIG. 3 shows a front view of a support structure constructed in accordance with the present invention used in conjunction with the modular target system of FIG. 1.
Figure 4:
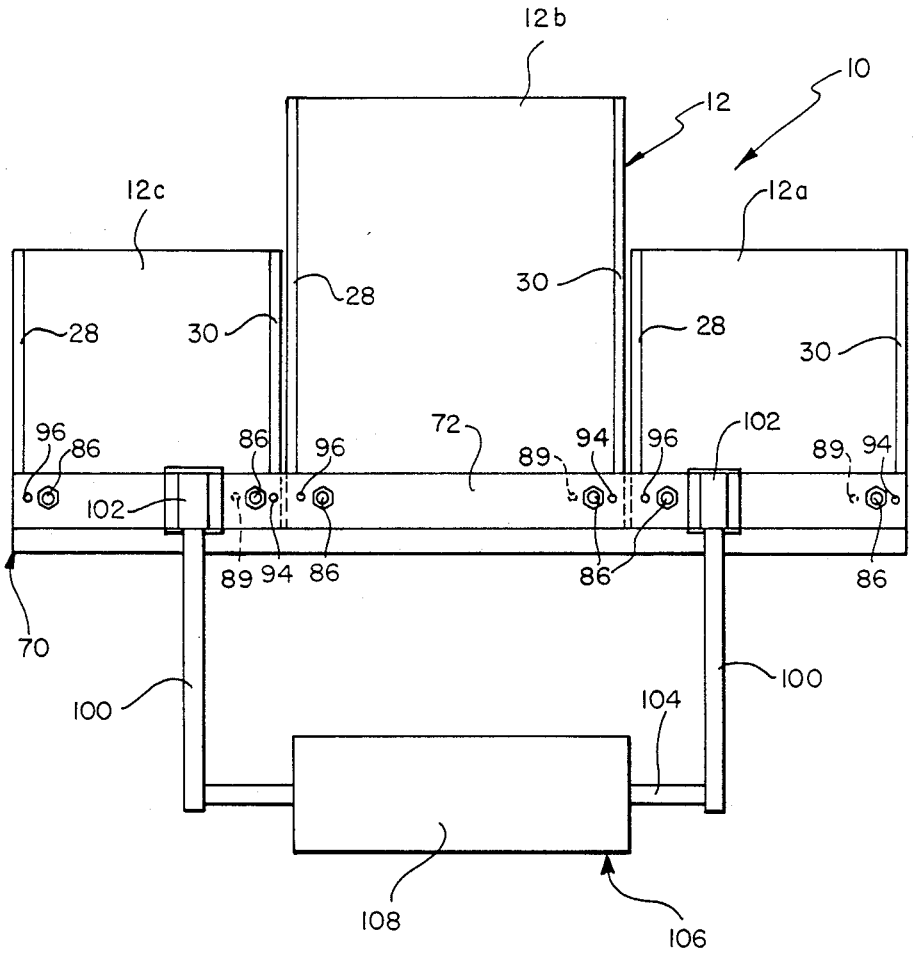
FIG. 4 shows a back view of the support structure shown in FIG. 3.

In a preferred embodiment, a support structure constructed in accordance with the present invention provides mechanical support and electrical contacts for target 12 of target system 10. Referring to FIGS. 3, 4, and 5, target 12 is detachably secured to support means 70. Support means 70 includes a support beam 72 comprising, for example, a hollow extruded aluminum beam. Support beam 72 extends the length of support means 70. Located on target side 73 of support beam 72, an insulative plate 74, comprising, for example, an epoxy-glass laminate, securely attaches to support beam 72 by an appropriate adhesive. Insulative plate 74 insulates support beam 72 from target 12.

For purposes of explanation, the support structure will now be described with respect to that portion which detachably supports and provides electrical contact for module 12*a*, a side view of which is shown in FIGS. 5 and 6. Mechanical support and electrical contact of target modules 12*b* and 12*c* is essentially the same as for that of target module 12*a*.

Support means 70 further includes clamping plate 76, comprising, for example, aluminum, for securing module 12*a* to support beam 72. Clamping plate 76 extends across the width of target module 12*a*. Located on target side 77 of clamping plate 76, insulative plate 78, comprising, for example, epoxy-glass laminate, securely attaches to clamping plate 76 by an appropriate adhesive. Insulative plate 78 insulates clamping plate 76 from target module 12*a* when target module 12*a* is mounted in place.

As shown in FIGS. 5 and 6, hinge 80, comprising for example, aluminum, mechanically connects clamping plate 76 to angled end stop bracket 82, comprising for example, aluminum, by bolts (not shown). Located on target side 83 of angled end stop bracket 82, spacer plate 84 comprises, for example, aluminum.

Referring again to FIGS. 5 and 6, bolt 86, containing a drilled and tapped hole corresponding to the thread size of bolt 88, protrudes through a hole (not shown) in support beam 72 and is securely fastened thereto by bolt 88, which protrudes through a hole (not shown) in the opposite side of support beam 72 (i.e., on target side 73 of support beam 72). At least two sets of bolts 86 and 88 are used in detachably securing target module 12*a* onto support means 70. Located proximate a first set of bolts 86 and 88, a locater bolt 89, comprising, for example, Delrin material (Delrin is a registered trademark of Dupont) (FIG. 3) is mounted on the target side 73 of support beam 72 to ensure that module 12*a* is positioned correctly on support means 70. Appropriately located holes in target module 12*a* fit over bolts 88 and the locater bolt 89 (FIG. 1) such that module 12*a* cannot be mounted incorrectly.

Bolt 88 contains a drilled and tapped hole (not shown) corresponding to the thread size of winged clamping bolt 90 (FIGS. 5 and 6). Winged clamping bolt 90 is flexibly attached to clamping plate 76 by lanyard 92. Winged clamping bolt 90, protruding through a hole in clamping plate 76, rotatably tightens into the drilled and tapped hole in bolt 88 so as to detachably secure target module 12*a* onto support means 70.

Electrical conductors 94 and 96, comprising , for example, brass screws, securely attach to support beam 72 (FIGS. 4, 5, and 6) via insulative sleeves 98. Insulative sleeves 98, comprising, for example, Delrin material, insulate conductors 94 and 96 from support beam 72 and are securely attached thereto by an appropriate means. The tips of electrical conductors 94 and 96 protrude through holes in insulative plate 74, thus leaving the tips exposed for making electrical contact with module 12*a*. Conductors 94 and 96 are located on support beam 72 to coincide and make electrical contact with bus-bars 30 and 28, respectively, of target module 12*a* when module 12*a* is detachably secured on support means 70. The opposite ends of conductors 94 and 96 are electrically connected to voltage source 44 via insulated conductive wires 35 and 37, respectively.

Referring now to FIG. 3, attached proximate opposite ends of support beam 72, legs 100, comprising, for example, aluminum alloy I-beams, mechanically connect at one end to support means 72. Support brackets 102, comprising, for example, low carbon cold rolled steel, mechanically connect legs 100 to support beam 72 by bolts (not shown). The opposite ends of legs 100 are mechanically connected to shaft 104 of a lifting mechanism 106. Shaft 104 extends through base 108 of lifting mechanism 106 in which there is a motor (not shown) for rotating the shaft 104 to swing support means 70 between a substantially vertical position (FIG. 3) and a substantially horizontal position (FIG. 5). The position of the support means 70 can be remotely controlled as by means of a radio controlled apparatus (not shown).

In operation, the support structure of the present invention provides mechanical support and electrical contacts for modular target system 10 and is ready to be fired upon as shown in FIGS. 3 and 4.

To mechanically support target module 12*a*, support means 70 is initially positioned by lifting mechanism 106 to be in a substantially horizontal position (FIG. 5). Winged clamping bolts 90 (one shown) are rotatably loosened and removed from bolts 88 and thus removed from clamping plate 76 and support beam 72. Clamping bolts 90 then hang freely while remaining flexibly attached to clamping plate 76 by way of lanyards 92 (one shown). With the clamping plate 76 resting in an upright position, being supported by hinge 80 and angled end stop bracket 82, target module 12*a* is guided onto support means 70 at a slight angle. Target module 12*a* is guided, contacting insulative plate 74, until the end of target module 12*a* hits the spacer plate 84 and thus the angled end stop bracket 82. Target module 12*a* is then set down horizontally whereby locating holes in target module 12*a* fit over bolts 88 and locator bolt 89 on support means 70. Once target module 12*a* is located, clamping plate 76 is pivoted onto target module 12*a*. Clamping plate 76 and angled end stop bracket 82 are allowed to move relative to support beam 72 in the y-direction (FIG. 5) so as to allow for variations in the thickness of target module 12*a*. A slight gap exists between the head of bolt 91 and the angled end stop bracket 82 so as to allow for this limited vertical movement. Winged clamping bolts 90 are then guided into holes through clamping plate 76 and into threaded holes in bolts 88. Clamping bolts 90 are rotated so as to tighten and secure target module 12*a* to support means 70. In a like manner, target modules 12*b* and 12*c* are detachably secured to target support means 70. Once the modules are installed, lifting mechanism 106 rotates target 12 via remote control (not shown) into a substantially vertical position whereby target 12 is ready to be fired upon (FIGS. 3 and 4).

In addition to being securely attached, target module 12*a* is electrically connected via support means 70 (FIG. 6). Upon securing target module 12*a* to support means 70, the head of conductive screw 94, which protrudes from the surface of beam 72 and insultative plate 74, impresses upon and deforms bus-bar 30 of target module 12*a* making electrical contact. Similarly, conductor 96 makes electrical contact with bus-bar 28 of target module 12*a*. In a like manner, electrical contact is made with target modules 12*b* and 12*c*.

For removing target module 12*a* from support means 70, a procedure, the reverse of that for installing, is followed. First, lifting mechanism 106 via remote control (not shown) rotates target 12 into a substantially horizontal position (FIG. 5). Winged clamping bolts 90 are rotated so as to untighten the same and are removed from bolts 88. Clamping plate 76 is then pivoted out of the way via hinge 80, whereby target module 12*a* can be removed. In a like manner, target modules 12*b* and 12*c* are removed from target support means 70.

A slight gap, typically on the order of $\frac{3}{8}$ inches, is present between each target module 12*a*, 12*b*, and 12*c* once mounted. Such a gap allows target modules 12*a*, 12*b*, and 12*c* to remain independant of each other under strong wind conditions while the target system 10 is in use. This gap is desireable in the instance when vibration sensors are used to sense a hit. In such an instance, if the target modules 12*a*, 12*b*, and 12*c* overlap, then a strong wind may trigger a false hit even though no hit occurred.

In the preferred embodiment, the support structure provides mechanical support and electrical contacts for the modular target system 10 to provide a thermal silhouette. When a thermal silhouette is desired, target system 10 is positioned such that backplane surface 26 faces the user in a substantially vertical position (FIG. 4). Voltage source 44 is activated to pass a current through each backplane 26 via conductors 94 and 96. Energized backplanes 26 of each target module 12*a*, 12*b*, and 12*c* thus present a thermal silhouette of desired shape to the user. When positioned with backplanes 26 facing the users, target system 10 is visible to both radar and laser sighting systems.

It will be appreciated that, while the target system and the support structure have been described with respect to specific materials, these materials have been chosen for specific characteristics, and that other materials displaying these characteristics may be substituted therefor. In addition, while the target system support structure has been described with respect to providing electrical contacts positioned for the target system to provide a thermal silhouette, these electrical contacts may be repositioned so as provide electrical contacts necessary for the target system to provide projectile size and hit location information. For example, the conductors 94 can be repositioned on support beam 72 to coincide with the center of backplane 26 of each target module. In addition, the conductors 96 may be repositioned on the clamping plates 76 to coincide with the conductive strips 24 of each target module. Furthermore, electrical conductors 38 and 32 (FIG. 1) may be connected to conductors 94 and 96, respectively to provide the necessary electrical connections for determining projectile hit size and location information.

There is thus provided a target system support structure which provides support and automatic electrical connections to a target upon mounting and securing of the target in place. The target support structure provides a novel support structure for target systems which provide thermal silhouettes of desired shapes and which further determine location and size information of projectile hits. The target system support structure provides for fast, easy replacement of destroyed targets and furthermore requires no tools on the outdoor target field.

While the invention has been particularly shown and described with reference to a preferred embodiment thereof, it will be understood by those skilled in the art that various changes in form and detail may be made therein without departing from the true spirit and scope of the invention defined by the appended claims.

What is claimed is:

1. A target system comprising:

a plurality of target modules, each of said modules having a dielectric support of selected shape defining a back surface with an electrically conductive strip backplane disposed on said back surface;

energizing means providing an electrical signal for passing a current through said conductive backplane of each said module so as to cause said backplane to generate a thermal image;

mechanical clamping means having oppositely disposed, relatively movable, insulated clamping surfaces for engaging and removably supporting said plurality of target modules relative to one-another so that said modules form a desired silhouette; and means, including electrical contacts having tips protruding through said clamping surfaces, for automatically applying said electrical signal from said energizing means by contact of said tips to said conductive backplanes of said plurality of target modules when said modules are engaged by said clamping means, so as to cause said plurality of target modules to generate a thermal image in the form of said desired silhouette.

2. A target system in accordance with claim 1 wherein said mechanical clamping means comprises a plurality of first and second plate pairs, means connecting said second plates for respective pivotal movement relative to said first plates from module unclamping positions in which said second plates are not parallel to said first plates, to module clamping positions in which said second plates are parallel to said first plates, and means for releasably locking said second plates in said clamping positions; and said electrical contacts are positioned on said plates to automatically make electrical contact with respective ones of said conductive backplanes on said plurality of target modules as said second plates are moved to said clamping positions to engage said target modules.

3. A target system in accordance with claim 2 wherein said clamping means further comprises a support beam and a plurality of angled end stop brackets attached to said support beam; and wherein said first plates are fixedly attached to said support beam, said second plates are hingedly attached to said brackets, and said releasable locking means comprises a plurality of winged clamping bolts dimensioned, configured and adapted for releasably securing said target modules to said support beam.

4. A target system in accordance with claim 3, wherein said brackets are attached to said beam by fastening means permitting relative movement of said brackets in a direction normal to said first plates.

5. A target system in accordance with claim 3, wherein said clamping bolts are flexibly attached to said second plates by lanyards.

6. A target system in accordance with claim 3, wherein said electrical contacts are fixedly attached to said beam and said tips protrude through said first plates.

7. A target system in accordance with claim 6, wherein said electrical contacts comprise brass screws.

8. A target system in accordance with claim 2 wherein said means connecting said second plates further comprises means respectively connecting said second plates for relative movement also along a direction normal to said first plates.

9. A target system as in claim 1, wherein said mechanical clamping means comprises means for respectively independently engaging and removably supporting said target modules in laterally-spaced positions relative to one-another so that said modules form a desired silhouette with a gap between each module.

10. A target system comprising:

a plurality of target modules, each of said modules having a dielectric support of selected shape defining a target surface with at least one electrically conductive strip disposed on said target surface;

sensing means providing an electrical signal for generating a pulsed electrical effect on said conductive strip on each said target module so as to detect the size and location of any hits through said target module;

mechanical clamping means having oppositely disposed, relatively movable, insulated clamping surfaces for engaging and removably supporting said plurality of target modules relative to one-another so that said modules form a desired silhouette; and means, including electrical contacts having tips protruding through said clamping surfaces, for automatically applying said electrical signal from said sensing means by contact of said tips to said conductive strips of sad plurality of target modules when said modules are engaged by said clamping means, so as to detect size and location of any hits through said plurality of target modules.

11. A target system in accordance with claim 10 wherein said mechanical clamping means comprises a plurality of first and second plate pairs, means connecting said second plates for respective pivotal movement relative to said first plates from module unclamping positions in which said second plates are not parallel to said first plates, to module clamping positions in which said second plates are parallel to said first plates, and means for releasably locking said second plates in said clamping positions; and said electrical contacts are positioned on said plates to automatically make electrical contact with respective ones of said conductive strips on said plurality of target modules as said second plates are moved to said clamping positions to engage said target modules.

12. A target system in accordance with claim 11 wherein said clamping means further comprises a support beam and a plurality of angled end stop brackets attached to said support beam; and wherein said first plates are fixedly attached to said support beam, said second plates are hingedly attached to said brackets, and said second releasable locking means comprises a plurality of winged clamping bolts dimensioned, configured and adapted for releasably securing said target modules to said support beam.

13. A target system comprising:

a plurality of target modules, each of said target modules having a dielectric support of selected shape defining mutually parallel target and back surfaces, a plurality of electrically conductive strips disposed on said target surface in generally parallel, spaced relationship, and a conductive backplane disposed on said back surface;

sensing means providing an electrical signal for generating a pulsed electrical effect on said conductive strips on each said target module so as to detect the size and location of any hits through said target module;

energizing means providing an electrical signal for passing a current through said conductive backplane of each said module so as to cause said backplane to generate a thermal image;

mechanical clamping means having oppositely disposed, relatively movable, insulated clamping surfaces for engaging and removably supporting said plurality of target modules relative to one-another so that said modules form a desired silhouette; and means, including electrical contacts having tips protruding through said clamping surfaces, for automatically applying said electrical signals from said sensing means and said energizing means by contact of said tips to said plurality of target modules when said modules are engaged by said clamping means, so as to detect size and location of any hits through said plurality of target modules and so as to cause said plurality of target modules to generate a thermal image in the form of said desired silhouette, respectively.

14. A target system in accordance with claim 13 wherein said mechanical clamping means comprises a plurality of first and second plate pairs, means connecting said second plates for respective pivotal movement relative to said first plates from module unclamping positions in which said second plates are not parallel to said first plates, to module clamping positions in which said second plates are parallel to said first plates, and means for releasably locking said second plates in said clamping positions; and said electrical contacts are positioned on said plates to automatically make electrical contact respectively with each of said conductive strips and each of said backplanes on said plurality of target modules as said second plates are moved to said clamping positions to engage said target modules.

15. A target system in accordance with claim 14 wherein said clamping means further comprises a support beam and a plurality of angled end stop brackets attached to said support beam; and wherein said first plates are fixedly attached to said support beam, said second plates are hingedly attached to said brackets, and said second releasable locking means comprises a plurality of winged clamping bolts dimensioned, configured and adapted for releasably securing said target modules to said support beam.

16. In a target system having a target module with an edge, an electrically conductive strip located on said module with at least a portion adjacent said edge, and means remote from said module for providing an electrical signal, a target module support structure comprising:

a body member;

first and second oppositely disposed insulated clamping elements;

means mounting said clamping elements on said body member for selective movement of said elements toward one another to a position to engage and removably support said target module by said edge inserted between said elements;

means, connected to said signal providing means and including electrical contacts having tips located to protrude out from said clamping elements, for automatically electrically connecting said signal providing means to said strip when said elements are moved to engage said target module; and means for releasably locking said clamping elements in said target module engaging position.

17. A target module support structure as in claim 16, wherein said body member comprises a beam, said first clamping element is fixedly attached to said beam, said electrically connecting means further comprises insulation sleeves passing through said beam, and said electrical contacts comprise contacts passing through said sleeves and having tips protruding out from said first element.

18. A target module structure as in claim 16, wherein said means mounting said clamping elements comprises means mounting said second clamping element for pivotal movement relative to said first clamping element.

19. A target module support structure as in claim 18, wherein said means mounting said second clamping element further comprises an angled bracket and means mounting said bracket to said beam for relative movement of said bracket in a direction normal to said first clamping element; and said means mounting said second clamping element comprises means hingedly mounting said second element to said bracket.

20. A target module support structure as in claim 19, in a target system wherein said module has a hole adjacent said edge, wherein said second clamping element has a hole; wherein said means for releasably locking comprises an externally threaded winged clamping bolt and a bolt with an internally threaded bore, said bored bolt being located on said beam and having a head protruding out from said first clamping element; and wherein said holes and bolts are relatively dimensioned, configured and adapted so that said bolt head extends into said module hole and said winged bolt extends through said second clamping element hole to threadingly engage with said internally threaded bolt when said clamping elements are in a desired correct said target module engaging position.

21. A target module support structure as in claim 20, in a target system wherein said module further has a second hole adjacent said edge, further comprising a locator member positioned on said beam and having a locator head protruding out from said first clamping element; and wherein said second hole and said locator head are relatively dimensioned, configured and adapted so that said locator head may be inserted into said second hole to determine said correct target module engaging position.

22. In a target system having a target module with an edge, an electrically conductive strip located on said module with at least a portion adjacent said edge, and means remote from said module for providing an electrical signal, a target module support structure comprising:

a beam;

a first clamping plate fixedly mounted on said beam;

a second clamping plate;

means mounting said second plate on said beam for selective movement pivotally and normally relative to said first plate from a module unclamping position to a module clamping position in which said target module is engaged and removably supported by said edge inserted between said plates;

means, connected to said signal providing means, for automatically electrically connecting said signal providing means to said strip when said second plate is moved to said module clamping position; and means for releasably locking said second plate in said clamping position.

23. A target module support structure as in claim 22, in a target system wherein said module has a hole adjacent said edge, wherein said means for releasably locking comprises a fastener element protruding from one of said plates; and wherein said hole and head are relatively dimensioned, configured and adapted so that said head will be inserted in said hole when said second plate is brought into said clamping position with said module in a desired engagement.

24. A target module support structure as in claim 23, in a target system wherein said module has a second hole adjacent said edge, further comprising a locator member having a locator head protruding from one of said plates; and wherein said second hole and locator head are relatively dimensioned, configured and adapted so that said locator head may be inserted into said second hole to determine said desired engagement.

* * * * *